US005276422A

United States Patent [19]

Ikeda et al.

[11] Patent Number: 5,276,422

[45] Date of Patent: Jan. 4, 1994

[54] SURGE ABSORBER

[75] Inventors: Fujio Ikeda; Takashi Shibayama, both of Saitama, Japan

[73] Assignee: Mitsubishi Materials Corporation, Tokyo, Japan

[21] Appl. No.: 942,429

[22] Filed: Sep. 9, 1992

[30] Foreign Application Priority Data

Sep. 17, 1991 [JP] Japan ..... 3-265300

[51] Int. Cl.[5] ..... H01H 61/00; H01H 71/16

[52] U.S. Cl. ..... 337/28; 337/16; 337/76; 361/124

[58] Field of Search ..... 337/28, 31, 32, 27, 337/14, 15, 16, 76; 361/119, 124; 337/76

[56] References Cited

U.S. PATENT DOCUMENTS 2,615,963 10/1952 Millen ..... 337/76

3,038,047 6/1962 Marquis ..... 337/76

*Primary Examiner*—Harold Broome

*Attorney, Agent, or Firm*—McAulay Fisher Nissen Goldberg & Kiel

[57] ABSTRACT

A surge absorber in which a thermal response switch is inserted in an input line at the input side of a surge absorbing element. The switch includes a conductive spring piece and a conductive hook piece. The base end of the conductive spring piece is fixed on either the first lead or the second leads and the tip of the conductive spring piece is provided with a pawl. The base end of the conductive hook piece is fixed on either the first lead or the second leads and the tip of the conductive hook piece is engaged with the pawl. At least one of the conductive spring piece and the conductive hook piece is made of a thermal response piece. Upon stopping of the applied continuous overvoltages or overcurrents, the switch can automatically be restored depending on an extent of the overcurrent by a manual operation.

8 Claims, 2 Drawing Sheets

SURGE ABSORBER

BACKGROUND OF THE INVENTION

This invention relates to a surge absorbing circuit suitable for an electronic device of communication equipment such as telephone sets, facsimiles, telephone switch-boards, modems, and the like and to a thermal response switch used for such surge absorbing circuit. More particularly, it relates to a surge absorbing circuit capable of protecting electronic devices from continuous overvoltages or overcurrents and to the thermal response switch used therefor.

It is known to connect a surge absorbing element to a pair of input lines of an electronic device in parallel with the electronic device, the surge absorbing element is designed to operate at a higher voltage than the operating voltage of the electronic device. Such a surge absorbing element is a resistor having a high resistance value when the voltage applied thereto is lower than the discharge starting voltage thereof, but its resistance value is equal to as low as several tens of ohms or less when the voltage applied thereto is equal to or higher than the discharge starting voltage thereof. Accordingly, when surge voltages, such as, lightning surges, etc., are instantaneously applied to an electronic device, the surge absorbing element discharges to absorb the surge voltages, and serves to protect the electronic device from the surge voltages. Thus, when an overvoltage or overcurrent due to an accident is continuously applied to the electronic circuit including the electronic device, a certain amount of current continuously flows through the surge absorbing element. This results in the surge absorbing element being heated to high temperatures. The heat radiating from the surge absorbing element can cause the electronic equipment surrounding the surge absorbing element to catch fire.

While it does not usually happen that such accidental overvoltages or overcurrents are continuously applied to the circuit, it has recently become desirable in more fields to take the maximum safety measures to avoid such accidental problems. As an example, UL (Underwriter's Laboratories Inc.) of the U.S.A. prescribes a safety standard for surge absorbers so that they do not cause fire or electrical shock in communication equipment when continuous overvoltages or overcurrents are applied.

A known surge absorber (1) capable of preventing fires of the communication equipment due to continuous overvoltages or overcurrents includes a fuse or a lower melting point metallic member adhered on the surface of the surge absorber element, and the resultant fuse or lower melting point metallic member is connected in series with the surge absorbing element (Unexamined Published Japanese Patent Applications No. 63-11022 and 63-18923).

We have also disclosed a surge absorbing circuit (2) wherein a surge absorbing element is connected to a pair of input lines of an electronic device in parallel with the electronic device and having a thermal response switch which is open by heating and closed by cooling connected to one side of the input lines at an input side of the surge absorbing element (Japanese Patent Application No. 3-28066, corresponding to U.S. patent application Ser. No. 07/827,375, filed Jan. 29, 1992). The thermal response switch is provided in the vicinity of the surge absorbing element and uses a thermal response piece, such as, a bimetal as a movable contact point.

We have also disclosed a thermal response switch (3) comprising a conductive movable body, a pair of thermal response pieces for holding the movable body upon non-heating and releasing it upon non-heating, a spring for separating the released movable body from the thermal response piece, and a reset pin for restoring the separated movable body (Japanese Patent Application No. 3-188027, corresponding to U.S. patent application Ser. No. 07/906,272, filed Jun. 26, 1992).

However in surge absorber (1) in which the fuse or the low melting point metallic member is connected in series with the surge absorbing element, if the fuse or the low melting point metallic member blows due to an applied overvoltage or overcurrent, the surge absorbing circuit is in the "open state", and it is troublesome to replace the surge absorber with a new one. In particular, if the surge absorbing element together with the fuse or the like is covered with a housing, a problem arises because it may be difficult to visually check the melting state of the fuse.

A problem with surge absorbing circuit (2) is that after the circuit is in the "open state" with the overvoltages or overcurrents imposed thereon, an automatic restoration function is available when the applied overvoltages or overcurrents cease. However, the thermal response piece of the movable contact point has only a slight contact pressure with the fixed contact point piece. As a result, vibration of the unit or thermal response switch causes temporary separation of the thermal response piece from the fixed contact point piece, which, in turn, results in the circuit disadvantageously being in "open state".

In thermal response switch (3), while the movable body securely contacts the thermal response piece due to the spring bias of a pair of the thermal response pieces during non-heating, and thus avoids any problem due to vibration, the structure of the switch is complicated resulting in higher costs because of larger housing size.

SUMMARY OF THE INVENTION

An object of the invention is to provide a surge absorber having a thermal response switch which can be manually restored to the closed state after the continuous overvoltages and overcurrents cease and which prevents the contact point from opening due to vibration.

Another object of the invention is to provide a surge absorber having a simple construction, compact size, and reduced cost.

Yet another object of the invention is to provide a surge absorber capable of preventing not only an abnormal overheating of the surge absorbing element upon applying continuous overvoltages and overcurrents, but also, thermal damage, fire, and the like of the electronic device, in addition to absorbing an instantaneous surge voltage, such as, a lightning surge.

A surge absorber according to the invention is a modification of a surge absorber in which a surge absorbing element is connected to a pair of input lines of an electronic device in parallel with the electronic device.

This is achieved with the inventive surge absorber which comprises:

A surge absorbing element connected across a pair of input lines of an electronic device with first and second leads connected to one input line at the input side of the surge absorbing element.

A third lead is connected to the other input line.

A thermal response switch is connected between the first and second leads and comprises a first conductive spring element having one end connected to the first or second lead and the other in the shape of a pawl; a second conductive element having one end connected to the first or second lead, and the other end being in the shape of a hook which is engageable with the pawl; wherein at least one of the first or second elements is made of a thermally responsive metal. The switch is closed when the hook and pawl are engaged and open when the hook and pawl are disengaged and the hook and pawl are movable between the engaged and disengaged positions in response to a change in temperature.

DESCRIPTION OF THE PREFERRED EMBODIMENT

Figure 1:
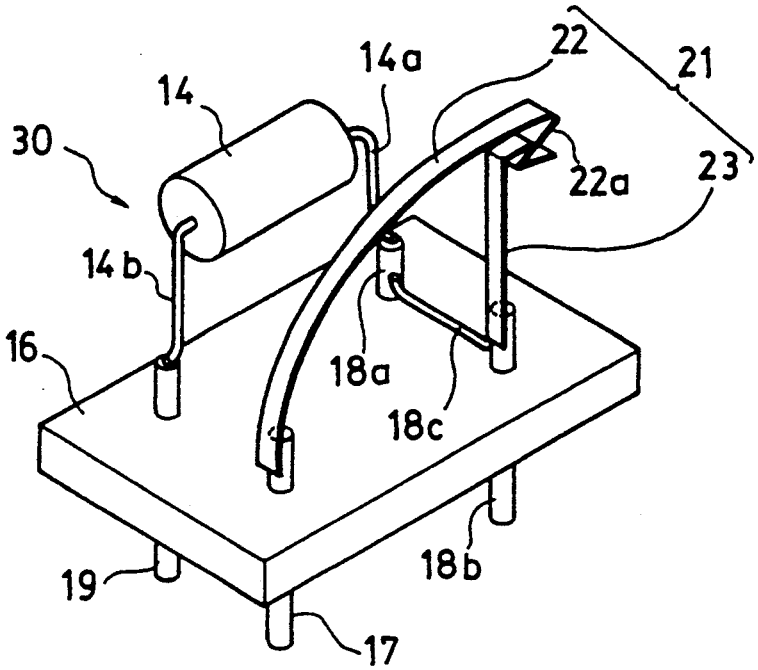
FIG. 1 is a perspective view of a surge absorber of an embodiment of this invention.

The thermal response switch according to the invention in normal operation is in the closed position in normal operation and is converted by thermal deformation to the open position. The thermal response switch is composed, at least in part, of a thermally responsive or activated material, e.g., a bimetal of conductive material or a shape memorizing alloy. The maximum operating temperature of the electronic device is normally 85° C., and the thermal response switch may preferably have an operation starting temperature in the range of 80° to 120° C. For this reason, a bimetallic switch may preferably be made of a combined member of two kinds of metallic pieces, each having a different thermal expansion coefficient, such as, brass - nickel - steel with a thermal deformation starting temperature of 80° to 100° C., or molybdenum - Invar with a thermal deformation starting temperature of 100° to 150° C., or brass - Invar, or the like. A switch of the shape memorizing alloy may preferably be a nickel - titanium alloy with a possible adjustment of transformation temperature up to 90° C., or a copper - zinc - aluminum alloy with a possible adjustment of transformation temperature up to 100° C.

The thermal response switch includes a first conductive spring piece having a pawl or catch on its tip and a second conductive piece which may or may not have spring properties and having a hook on its tip which is securely engageable with the pawl. By "securely engageable" is it meant that vibration to which the inventive surge absorber might be subjected, will not cause the pawl to disengage and thus, break contact, with the hook member. Either the conductive spring piece or the conductive hook piece, or both, are formed from a thermally responsive material. The pawl of the conductive spring element is engaged with the hook and in this engaged position, is biased so that on release, it springs away from the hook to break contact. This movement of the first and second pieces away from each other may be assisted by their thermal deformation properties.

The surge absorbing element can be a semiconductor type surge absorbing element, such as, a zinc oxide varistor, a silicon carbide varistor, a zener diode and the like; a filter type surge absorbing element, such as, a CR filter obtained by combining a capacitor with a resistor, a CL filter obtained by combining a capacitor with a coil and the like; a gap type surge absorbing element, such as, an air-gap type discharge tube and a micro-gap type discharge tube and the like.

Continuous overvoltages and overcurrents applied to the input lines cause the first piece and/or second piece to generate heat. Upon reaching a sufficiently high temperature, the first, i.e., spring piece and/or the second, i.e., hook piece undergo deformation because of their thermally responsive properties so as to result in release of the pawl from the hook. Because of its spring biased position, the spring piece springs away from the hook thus breaking the contact. In this way, the overvoltages or overcurrents do not reach or damage the electric device and the surge absorbing element.

After interruption of the overvoltages or overcurrents, the conductive spring piece and the conductive hook piece return to a lower normal temperature. This results in their returning also to their original undeformed state. If the hook piece has not been fused by the overcurrents, the pawl can be manually engaged with the hook piece, thus placing the spring piece in biased deformation against the hook. Because of the spring bias, the spring piece and the hook piece are securely held together and connection of the electronic device with the input lines is maintained even when subjected to vibration.

In the prior art surge absorber, the surge absorber circuit remains interrupted because of melting of the metal and it is difficult to restore the circuit or the surge absorber which is capable of resetting the circuit, the reestablished contact is insecure and can be interrupted due to vibration. With the surge absorber of this invention, the circuit can be rapidly interrupted upon imposition of an overvoltage or overcurrent. Also, after the interruption, the circuit can be easily and securely restored depending on the extent of the overcurrent, by manually forcing the spring piece into position to reengage the hook piece.

In an embodiment described hereinafter, the inventive surge absorber may also comprise a housing. The housing may have means for visually observing or determining the position of the first piece, i.e., whether it is in the open position. In addition, the window may provide access to the interior of the housing so as to reengage the first and second pieces. The simplified construction of the inventive surge absorber enables it to be produced at a low cost and in a compact size.

In this specification, the term "an overvoltage or overcurrent" means an abnormal voltage above a discharge starting voltage of a surge absorbing element or an abnormal current accompanied by the abnormal voltage.

DESCRIPTION OF THE PREFERRED EMBODIMENT

Figure 2:
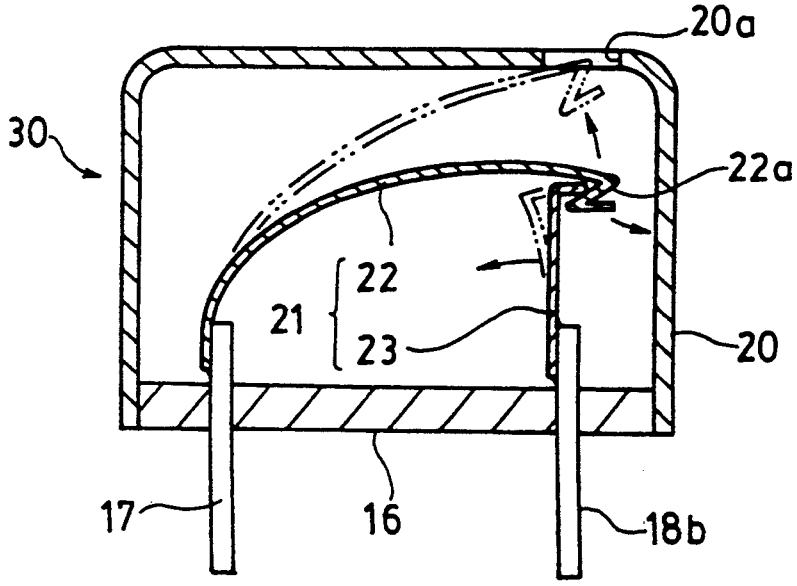
FIG. 2 is a sectional view of the surge absorber shown in FIG. 1.
Figure 3:
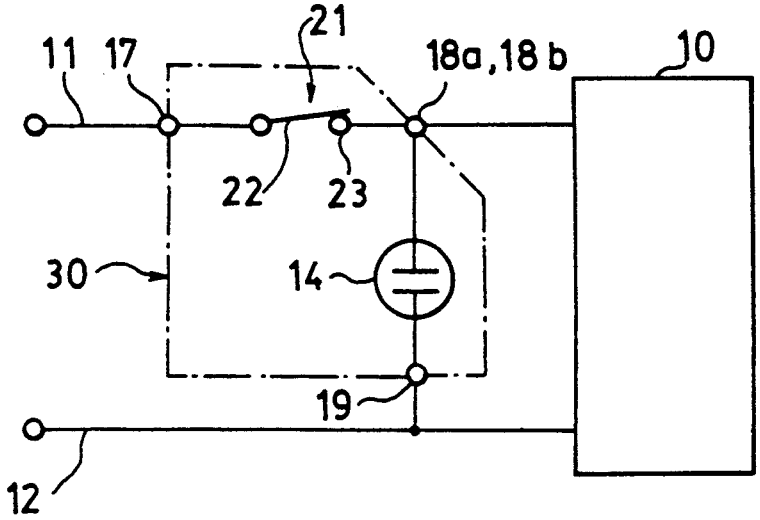
FIG. 3 is a circuit diagram of the surge absorbing circuit including the surge absorber.

As shown in FIGS. 1 to 3, a pair of input lines 11 and 12 of an electronic device 10 of communication equipment are connected to a surge absorbing element 14 in parallel with the electronic device 10. Input line 11 is at an input side of the surge absorbing element 14 and is connected thereto by thermal response switch 21 which is open by heating and closed by cooling. The surge absorber 30 comprises the surge absorbing element 14 and the thermal response switch 21.

In this example, the surge absorbing element 14 is a micro-gap type discharge tube with a discharge starting voltage of 300V. Element 14 is prepared by a method such that a micro-gap of several tens of microns is formed in the circumference direction of a ceramic element of a columnar shape enveloped with a conductive film. Cap electrodes are provided on both ends of the ceramic element, and after the cap electrodes are connected with lead wires, the resultant member is sealed into a glass tube together with an inert gas.

An insulating base plate 16 having the rectangular shape of surge absorber 30 is provided with four pin-shaped leads 17, 18*a*, 18*b* and 19 which penetrate the base plate 16 at the vicinity of the four corners thereof, and a housing 20 to cover the base plate 16. A window 20*a* is positioned on the housing 20 opposing lead 18*b* of base plate 16.

Leads 17, 18*a*, 18*b* and 19 are made of conductive material, and, in this example, of iron - nickel alloy. The respective lower ends of leads 17, 18*a* and 18*b* are connected to input line 11 at the input side of surge absorbing element 14, and a lower end of lead 19 is connected to input line 12 at the output side of the surge absorbing element 14. On base plate 16, leads 18*a* and 19 are weld connected to leads 14*a* and 14*b*, respectively, of surge absorbing element 14. Also, on base plate 16, leads 18*a* and 18*b* are connected by a conductive wire 18*c*. Conductive wire 18*c* may preferably be omitted by changing two leads 18*a* and 18*b* into a piece of lead, or by connecting the leads 18*a* and 18*b* with each other within a circuit substrate (not shown) in which both leads are inserted.

Between lead 17 and lead 18*b*, a thermal response switch 21 is provided which is composed of an extended conductive spring piece 22 and a conductive hook piece 23, which is shorter than the spring piece 22. The base end of the conductive spring piece is weld connected to lead 17, and the tip thereof extends above lead 18*b* and has a "Z" letter shaped pawl 22*a*. The conductive hook piece 23 has an upside down "L" letter shape at its tip and the base end thereof is weld connected to lead 18*b*. The tip is engaged with the pawl 22*a*. In this example, spring piece 22 and hook piece 23 are bimetallic elements of two kinds of metallic pieces of manganese and Invar, each having a different coefficient of thermal expansion. When the temperature exceeds about 100° C., thermal deformation takes place as shown in two point chain lines and arrows in FIG. 2 which allows pawl 22*a* to be released from the hook piece 23, and the pawl 22*a* moves to and faces window 20*a* of housing 20.

In the surge absorber 30 thus constructed, if continuous overvoltages or overcurrents are applied to input lines 11 and 12 of the electronic device 10, spring piece 22 and hook piece 23 of the thermal response switch 21 each generate heat because each is a resistor. Spring piece 22 and hook piece 23 are heated to a specified temperature as a thermal response piece, and then are thermally deformed. This causes the pawl 22*a* to be released from the hook piece 23 and to appear in the window 20*a* of the housing 20 as shown in FIG. 2. Thus, the thermal response switch 21 is open and the overvoltages or overcurrents are not applied to the electronic device 10 and surge absorbing element 14.

After the overvoltages or overcurrents cease, the temperatures of spring piece 22 and hook piece 23 decrease, and the elements of the thermal response piece are restored to their shape prior to the heat deformation. However, because of the spring elasticity of the spring piece 22, the hook and pawl are not engaged and the switch 21 remains open. If the hook piece 23 has not been fused due to the overcurrents, the thermal response switch 21 can be closed again. In this case, a thin insulating rod (not shown) is inserted into window 20*a* to depress the tip of spring piece 22. The spring piece 22 and the hook piece 23 are elastically deformed to be engaged and secured together, allowing the electronic device lo to be connected to the input lines 11 and 12. The spring piece 22 and the hook piece 23 are engaged with each other at a high contact-pressure because of their spring elasticity. As a result, the thermal response switch 21 exhibits an improved resistance to vibration.

The operational state of the thermal response switch 21, i.e., whether it is closed or open, can easily be checked visually by the presence of pawl 22*a* in the window 20*a*.

COMPARATIVE EXAMPLE

Figure 4:
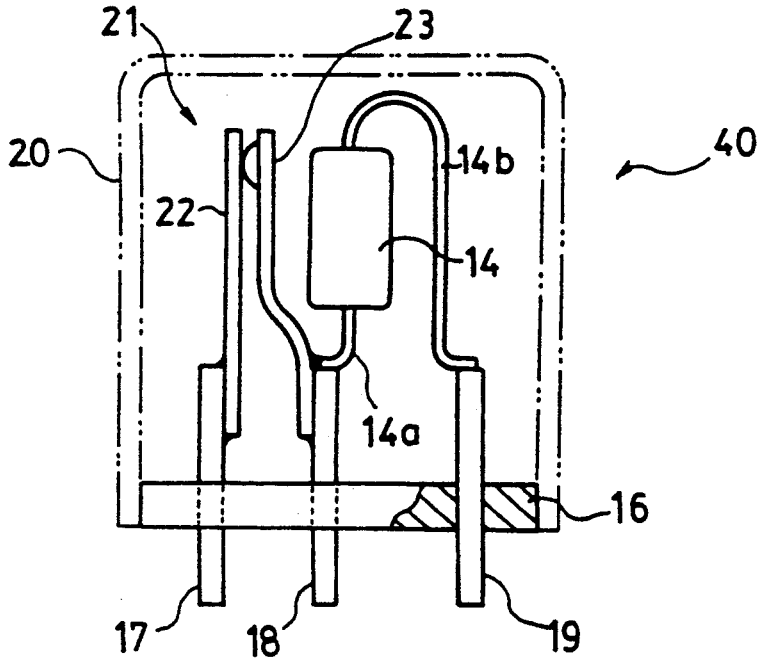
FIG. 4 PRIOR ART
FIG. 4 is a front view of a surge absorber of a prior art example.

FIG. 4 shows a comparative example with respect to a surge absorber 40. The same reference numerals as in FIG. 1 designate the same structural elements in the drawing. Lead 17 is connected to input line 11 at the input side of surge absorbing element 14 as shown in FIG. 3. Lead 18 is connected to the input side of the electronic device, and lead 19 is connected to input line 12. The surge absorbing element 14 is connected across the 18 and lead 19 through leads 14*a* and 14*b*, and the thermal response switch 21 is inserted and connected across leads 17 and 18. The thermal response switch 21 is a normally closed bimetallic switch which is open by heating and closed by cooling. A fixed contact point piece 22 of switch 21 is weld connected to lead 17 and bi-metallic piece 23 thereof is weld connected to lead 18.

Overvoltage Overcurrent Test and Result Thereof

A test for the overvoltages and overcurrents was conducted for the surge absorber with respect to both the inventive embodiment of the Example and the Comparative Example. The thermal response switch 21 was inserted into input line 11 as shown in FIG. 3, and the surge absorbing element 14 was connected in parallel with the electronic device 10. Two tests were performed; (a) AC 600V voltage was applied to each of input lines 11 and 12 of this test circuit and a current of 0.25 A was allowed to flow, and (b) AC 600V voltage was applied to the same and a current of 40 A was allowed to flow.

As a result, in surge absorber 40 of the Comparison Example, in test (a), an "on-state" was observed during a very short time at about every five seconds after such voltage was applied, and upon stopping the applied voltage, the switch 21 was automatically restored. In test (b), the switch 21 opened in about ten milliseconds after the voltage was applied, and upon stopping the applied voltages, the switch 21 was automatically restored. When the surge absorber was subjected to vibration by a rubber tipped rod, however, the contact point of bimetallic piece 23 was temporarily separated from fixed contact point piece 22, and the surge absorber 40 generated a noise and malfunctioned.

In contrast, in surge absorber 30 of the embodiment according to the invention, in test (a), switch 21 opened about six seconds after the voltage was applied. When spring piece 22 is forced in after stopping the applied voltage, the switch 21 is reset. In test (b), the switch 21 opened in about ten milliseconds after the voltages were applied. In test (b), the hook piece 23 was fused due to the large current flow, and even after stopping the applied voltage, switch 21 could not be reset even with forcing-in of spring piece 22. If such fusion does not occur, however, the pieces can be reengaged, and upon applying the similar vibration as in the comparative example, the switch 21 is not affected and remains closed.

What is claimed is:

1. A surge absorber comprising:

a surge absorbing element connected across a pair of input lines of an electronic device;

first and second leads connected to one input line at an input side of the surge absorbing element;

a third lead connected to the other input line;

a thermal response switch between and connecting the first and second leads to one another and comprising:

a first conductive spring element having an end connected to one of the first or second leads and another end comprising a pawl;

a second conductive element having an end connected to the other of the first or second leads, another end of the second element being a hook engageable with the pawl;

wherein at least one of the first or second elements is made of a thermally responsive metal;

the switch being closed when the hook and pawl are engaged and open when the hook and pawl are disengaged; and wherein the hook and pawl are movable from the engaged to the disengaged position in response to a temperature increase, and means for allowing the first spring element to be moved from the disengaged to the engaged position.

2. The surge absorber of claim 1 which further comprises visual means for determining if the first spring element is in the disengaged position.

3. The surge absorber of claim 1 wherein the surge absorber is enclosed is a housing, the housing having a window for visually determining if the first spring element is in the disengaged position and for allowing the first spring element to be moved from the disengaged to the engaged position.

4. The surge absorber of claim 1 wherein each of the first and second elements are composed of thermally responsive metals.

5. The surge absorber of claim 1 wherein the second element also possesses spring properties.

6. The surge absorber of claim 1 wherein the pawl and hook, when engaged, are spring biased so as to be resistant to disengagement due to vibration.

7. The surge absorber of claim 1 wherein the thermally responsive metal is selected from the group consisting of shape memorizing alloys and bimetallic elements.

8. A surge absorber comprising:

a surge absorbing element connected across a pair of input lines of an electronic device;

first and second leads connected to one input line at an input side of the surge absorbing element;

a third lead connected to the other input line;

a thermal response switch between and connecting the first and second leads to one another and comprising:

a first conductive spring element having an end connected to one of the first or second leads and another end comprising a pawl;

a second conductive element having an end connected to the other of the first or second leads, another end of the second element being a hook engageable with the pawl;

wherein at least one of the first or second elements is made of a thermally responsive metal;

the switch being closed when the hook and pawl are engaged and open when the hook and pawl are disengaged; and wherein the hook and pawl are movable from the engaged to the disengaged position in response to a temperature increase, wherein the surge absorber is enclosed in a housing, the housing having a window for visually determining if the first spring element is in the disengaged position, pushing means for insertion through said window and depressing said first spring element to move said first spring element from the disengaged to the engaged position.

* * * * *